US005897042A

United States Patent [19]

Sims

[11] Patent Number: 5,897,042

[45] Date of Patent: Apr. 27, 1999

[54] TALKING BACKPACK

[76] Inventor: Dianne Sims, 1914 Long Dr., Decatur, Ga. 30032

[21] Appl. No.: 09/033,535

[22] Filed: Mar. 2, 1998

[51] Int. Cl.[6] ..... A45C 15/00; A45F 3/04

[52] U.S. Cl. ..... 224/576; 224/652; 224/645; 224/930; 446/81; 446/302; 446/404; 206/457; 206/542; 455/344; 455/351

[58] Field of Search ..... 224/575, 576, 224/153, 627, 650, 652, 929, 930, 645; 150/106, 112; 190/109, 111; D3/215, 216, 217, 218; 455/344, 347, 351; 446/81, 302, 303, 404; 206/457, 541, 542, 314; D14/160, 164, 165, 177, 189, 190

[56] References Cited

U.S. PATENT DOCUMENTS

| | | | |
|---|---|---|---|
| D. 317,452 | 6/1991 | Garab | D3/218 X |
| D. 351,943 | 11/1994 | Young | D3/216 |
| D. 360,207 | 7/1995 | Grasso et al. | D14/165 |
| 3,162,977 | 12/1964 | Elischer | 446/303 |
| 4,050,493 | 9/1977 | Cho | 150/112 X |
| 4,579,540 | 4/1986 | Ho | 455/344 |
| 4,856,087 | 8/1989 | Nesbit | 455/344 |
| 5,474,484 | 12/1995 | Lemelle | 446/302 X |

*Primary Examiner*—Gregory M. Vidovich
*Attorney, Agent, or Firm*—William B. Noll

[57] ABSTRACT

A combination backpack and audio cassette system wherein the audio cassette system, separately contained, is mounted to the back panel of the backpack. The contained audio cassette system is provided with a simulated face, where the components thereof are accessible through various features of the simulated face, such as the mouth, nose, and ear.

6 Claims, 1 Drawing Sheet

TALKING BACKPACK

FIELD OF THE INVENTION

Invention is directed to the field of utilitarian backpacks, particularly for use by young school children, that incorporates a system to record and playback, such as school messages and class assignments.

BACKGROUND OF THE INVENTION

The present invention relates to a talking backpack that includes a system to record and playback of school assignments. For early grade school students, where enthusiasm for school is quite strong, the invention hereof can serve as fun, motivational, and as a mechanical instrument that can intensify the student's desire to embark upon his or her assignments. Further, it provides an opportunity for a parent to share in the school experience, and to encourage the student.

The prior art offers some related devices, but not all of the versatility available with the present invention. The prior art is reflected by the following:

a.) U.S. Pat. No. 5,409,152, to Trevino, discloses a backpack assembly for holding audio components comprising a backpack having lower, upper, front, rear and two side faces. One of the side faces includes a plurality of pockets formed interiorly of the bag. One of the plurality of the pockets is sized to hold a speaker therein and a second of the plurality of pockets is sized to hold a radio therein wherein the radio and the speaker are operatively connected by a speaker wire extending from the speaker to the radio.

b.) U.S. Pat. No. 5,353,975, to Libertucci, discloses a battery and equipment vest, to be rechargeably used to provide power to video, recording, and like equipment The battery and equipment vest which also provides numerous storage pockets, may utilize a battery belt or integrally disposed batteries and recharging equipment to provide a mobile, conveniently disposed power source, which may be recharged without removal from the vest. In order to ensure a comfortable fit for multiple users, the battery and equipment has adjustable shoulder straps and an adjustable waist design which is structured and disposed to orderly maintain electrical interconnection between front portions and rear portions of the vest when worn by any size user. Additionally, fastener hooks and accessory rings are employed for attaching a wide variety of peripheral equipment, supplies, tools, and extra batteries.

c.) U.S. Pat. No. 5,211,321, to Rodriquez, discloses a multi-compartmented belt-type carrier for a portable stereo unit having separate speakers. Each compartment is designed to receive a speaker and has a front face that includes at least one foraminous area that functions to allow a virtually non-obstructed transmission of sound from a housed speaker to the environment. The carrier includes a movable cover member that is adapted to overlie the compartments. In addition, a flexible base is used to support the compartments, thereby allowing relative movement between the compartments and enhancing the fit of the device to the wearer.

d.) U.S. Pat. No. 4,878,871, to Noto, discloses, by the use of a toy, a system for preparing and conveying a personalized message from a sender to a recipient utilizing a toy having a cavity containing a cassette player, a battery holder, a switch and circuit elements interconnecting the player, the holder and the switch. The system includes the following steps which are performed by the sender; personally taping the personalized message on a cassette, inserting the cassette in the player, and giving the toy to the recipient with the cassette therein. The toy is cuddly and may be in the form of a teddy bear, and includes a flap that is movable between a closed position in which the flap covers the cavity, and an open position in which the cavity is exposed. The switch is of the push button type and the push buttons produce bulges in the flap when the latter is closed, so that the switch can be operated without moving the flap to the open position.

The present invention offers a unique motivational tool, especially for younger students, the talking backpack hereof can provide advantages to all students in organizing school assignments. The manner by which this unique tool is realized will become apparent from the following description, particularily when read in conjunction with the accompanying drawings.

SUMMARY OF THE INVENTION

The present invention is directed to a juvenile or adult backpack that incorporates an audio system having means for recording and receiving messages, such as school assignments. The invention comprises a conventional backpack having shoulder straps for transporting same on the user's back, a primary compartment for carrying books and supplies, and a secondary, external compartment for containing the audio transmission system. The secondary compartment, along its major outer face, or panel, preferably includes a simulated face, such as a clown's face, where the facial features may incorporate the means for operating the audio system. For example, the nose may include a button to record messages, while the mouth may include a speaker to listen to messages. Adjacent the mouth may be "rewind" and "playback" buttons which could simulate dimples, for example. Along the side panels, perpendicular to the major face, a microphone may be placed in the ear of the simulated face.

Accordingly, an object of this invention is to provide an instructional and motivational tool, especially for early age school children, in organizing school assignments.

Another object hereof is to provide a guide to parents on the student's homework assignments, and to help direct the student in his or her efforts to complete the assignments.

A further object, by the use of pre-recorded messages by the parent or teacher, helps to promote improved speaking skills, and to give the student encouragement in verbally recording homework assignments. Additionally, by the use of a pre-recorded question/check reminder system, it helps to promote better preparedness in school, which in turn would foster growth in self esteem, self confidence, and a sense of responsibility.

These and other objects will become apparent to those skilled in the art from a reading of the following specifications.

DETAILED DESCRIPTION OF PREFERRED EMBODIMENTS

Figure 1:
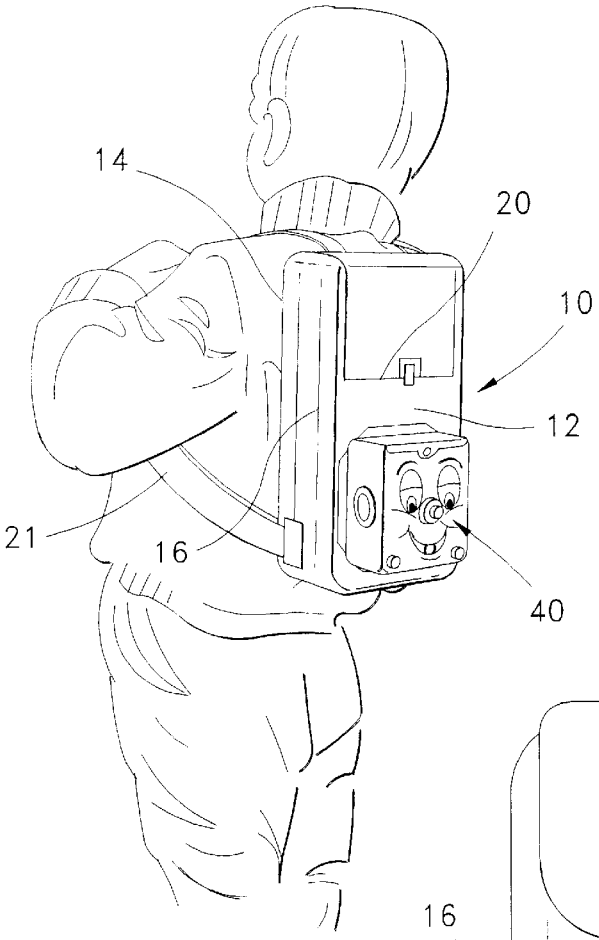
FIG. 1 is a perspective view of the talking backpack in accordance with the present invention, where such backpack is shown as being transported by a child.

The present invention is directed to a versatile, talking backpack that is particularly useful for early age school children. Referring to the several Figures, where like reference numerals represent like components or features throughout the several views, the talking backpack 10, fabricated from a canvas-like fabric, or vinyl, or a combination thereof includes a primary compartment, as known in the art, for storing books, supplies and the like. The primary compartment is defined by a front panel 12, rear panel 14, and a pair of side panels 16 and bottom panel 18 extending between said front and rear panels. For access to said primary compartment, a releasable flap 20 may be provided. It will be understood that it is within the scope of this invention to provide multiple sections or subcompartments in the primary compartment. Finally, to transport the backpack hereof a pair of shoulder straps 21 may be provided.

Figure 3:
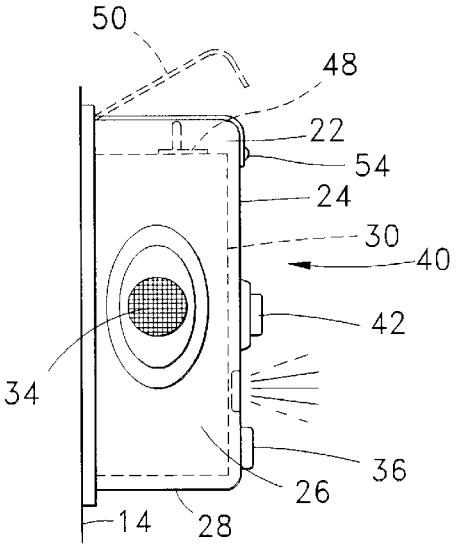
FIG. 3 is a side view thereof, with the audio system shown in phantom lines.

The crux of the invention is the combination of a secondary and distinct compartment 22, as best seen in FIG. 3, extending from the rear panel 14. Comparable to the primary compartment, the secondary compartment 22 is defined by an outer face 24, spaced from the rear panel 14 by a pair of side panels 26 and floor panel 28. Within the secondary compartment 22 there is provided an audio system 30, such as a cassette tape player, as known in the art, featuring a speaker 32, a microphone 34 for recording messages, playback and rewind buttons 36, 38, respectively, and an on/off switch. Additionally, a power source, preferably in the form of portable batteries, may be provided in the secondary compartment 22.

Figure 2:
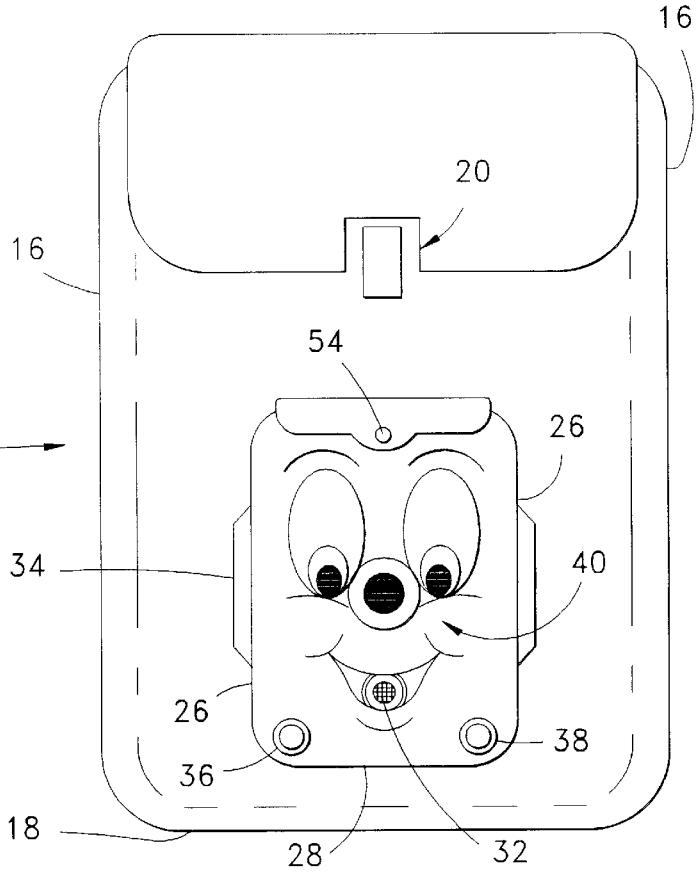
FIG. 2 is a front view of the backpack hereof, illustrating in particular a simulated face, such as a clown, where features of a complementary audio system have been incorporated into the face.

To aesthetically enhance and personalize the backpack of this invention, the outer face 24 and side panels 26 cooperate to provide a 3-dimensional appearance to present a simulated face 40, as best seen in FIGS. 1 and 2. Specifically, the audio system features may by incorporated into the simulated face 40. For example, the microphone 34 may be placed in one "ear" along a side panel 26. To record a message or an assignment into the "ear", the "nose" may include a push button 42 to effect the recording of such message or assignment. The "mouth" may include the speaker 32, for example. Since a common feature of a cassette tape player is to provide "rewind" and "playback" capabilities, appropriate buttons 38, 36, respectively, may be provided and positioned to simulate dimples, for instance.

Finally, a convenient on/off switch 48 is included along the top of the audio system 30, and for access thereto, a releasably securable flap 50 may be provided, where said flap 50 is secured to the outer face 24, such as by a snap or by VELCRO-type fastener 54 (hook and loop fastener).

While a preferred embodiment for a talking backpack has been described above, it is recognized that variations may be had with respect to the backpack in accordance with this invention. Therefore, while the invention has been disclosed in a preferred form only, it will be obvious to those skilled in the art that many additions, deletions and modifications can be made therein without departing from the spirit and scope of this invention, and that no undue limits should be imposed thereon except as set forth in the following claims.

I claim:

1. A combination backpack and integral audio cassette system, said system comprising:

a) a backpack for use on a person, said backpack including a primary compartment having an essentially planar back panel;

b) a secondary compartment mounted to an exterior side of said back panel, said secondary compartment comprising a pair of side walls, a floor extending between said side walls, and an outer wall wherein said floor and said side walls extend between said back panel and said outer wall; said outer wall having a simulated face of an animate being thereon extending between said side walls wherein said simulated face having facial features; and c) an audio cassette system, said audio cassette system contained within said secondary compartment, said audio cassette system including operable components to operate said audio cassette system wherein said operable components are respectively incorporated into said facial features of said simulated face.

2. A combination backpack and integral audio cassette system as defined in claim 1 wherein the backpack includes a pair of shoulder straps for temporarily securing said backpack to a person.

3. A combination backpack and integral audio cassette system as defined in claim 1 wherein said operable components of said audio cassette system include a microphone and a button which starts a recording process of said audio cassette system, said microphone incorporated into an ear on one of said side walls and said button incorporated into a nose of said simulated face.

4. A combination backpack and integral audio cassette system as defined in claim 3 wherein said operable components of said audio cassette system further including playback and rewind controls, each of said controls externally provided along said simulated face.

5. A combination backpack and integral audio cassette system as defined in claim 4 further including a selectively closeable cover operatively secured with said secondary compartment, said cover providing access to an on/off switch on said audio cassette system contained in said secondary compartment.

6. A combination backpack and integral audio cassette system as defined in claim 1 wherein said operable components of said audio cassette system include a speaker, said speaker incorporated into a mouth of said simulated face.

* * * * *